US008860308B2

(12) United States Patent
Brauner et al.

(10) Patent No.: US 8,860,308 B2
(45) Date of Patent: Oct. 14, 2014

(54) HIGH-PRESSURE DISCHARGE LAMP HAVING A STARTING AID

(75) Inventors: Thomas Brauner, Berlin (DE); Martin Fornalski, Berlin (DE); Juergen Kellerer, Berlin (DE)

(73) Assignee: OSRAM AG, Munich (DE)

( * ) Notice: Subject to any disclaimer, the term of this patent is extended or adjusted under 35 U.S.C. 154(b) by 0 days.

(21) Appl. No.: 13/497,809

(22) PCT Filed: Aug. 12, 2010

(86) PCT No.: PCT/EP2010/061782

§ 371 (c)(1),
(2), (4) Date: Mar. 23, 2012

(87) PCT Pub. No.: WO2011/038975

PCT Pub. Date: Apr. 7, 2011

(65) Prior Publication Data

US 2012/0223638 A1 Sep. 6, 2012

(30) Foreign Application Priority Data

Sep. 30, 2009 (DE) ..... 20 2009 013 182 U

(51) Int. Cl.
*H01J 61/34* (2006.01)
*H01J 61/54* (2006.01)

(52) U.S. Cl.
CPC ..... *H01J 61/547* (2013.01); *H01J 61/34* (2013.01)
USPC ..... 313/623; 313/624

(58) Field of Classification Search
USPC ..... 313/623
See application file for complete search history.

(56) References Cited

U.S. PATENT DOCUMENTS

| | | | |
|---|---|---|---|
| 4,053,809 | A | 10/1977 | Fridrich et al. |
| 5,955,845 | A | 9/1999 | Fellows |
| 6,268,698 | B1 | 7/2001 | Scholz |
| 2004/0036416 | A1 | 2/2004 | Scholz |
| 2004/0227445 | A1 | 11/2004 | Kai et al. |
| 2006/0170363 | A1 | 8/2006 | Utsubo et al. |
| 2007/0170363 | A1 | 7/2007 | Schimert et al. |

FOREIGN PATENT DOCUMENTS

| | | | |
|---|---|---|---|
| EP | 0967631 | A1 | 12/1999 |
| EP | 0922296 | B1 | 3/2002 |
| JP | 11513189 | A | 11/1999 |
| JP | 2001283781 | A | 10/2001 |
| JP | 2004335461 | A | 11/2004 |
| WO | 2005041835 | A2 | 5/2005 |

OTHER PUBLICATIONS

English abstract of JP 2001283781 A, dated Oct. 12, 2001.
English abstract of JP 2004335461 A, dated Nov. 25, 2004.
Office action issued in the corresponding Chinese application No. 201080043943.2 dated Mar. 4, 2014, 6 pages.

*Primary Examiner* — Mary Ellen Bowman

(57) ABSTRACT

In various embodiments, a high-pressure discharge lamp including a starting aid and a longitudinal axis having a ceramic discharge vessel that is housed in an outer bulb, the discharge vessel having two ends having including capillaries with electrodes fastened therein, wherein a frame having a hanger wire holds the discharge vessel in the outer bulb and the hanger wire is configured so that it includes a plate-like starting aid toward the capillary of the opposite-pole electrode, with the plate-like starting aid being configured as a foil or metal sheet and the plate-like starting aid further including a means for purely mechanical fastening to at least the capillary.

9 Claims, 5 Drawing Sheets

HIGH-PRESSURE DISCHARGE LAMP HAVING A STARTING AID

RELATED APPLICATIONS

The present application is a national stage entry according to 35 U.S.C. §371 of PCT application No.: PCT/EP2010/061782 filed on Aug. 12, 2010, which claims priority from German Application No.: 20 2009 013 182.3, filed on Sep. 30, 2009.

TECHNICAL FIELD

Various embodiments relate to a high-pressure discharge lamp having a starting aid and a longitudinal axis having a ceramic discharge vessel that is housed in an outer bulb. Lamps of this kind are in particular high-pressure discharge lamps for general lighting or for photo-optical purposes.

BACKGROUND

Known from U.S. Pat. No. 6,268,698 is a high-pressure discharge lamp having a discharge vessel in which a starting aid is based on a long frame wire. The starting aid is a separate component extending at the height of a capillary in the direction of the discharge vessel. The drawback of an arrangement of this kind is that the starting aid is complex and expensive to install.

SUMMARY

Various embodiments provide a high-pressure discharge lamp whose ignition is ensured with simple inexpensive means. This applies in particular to metal halide lamps, wherein the discharge vessel can be made of a ceramic material.

Particularly advantageous embodiments may be found in the dependent claims.

According to various embodiments, a separate component is now used on the frame extending in the direction of a capillary. The component starts at the long power supply lead, the so-called hanger wire of the frame, and, to be precise, preferably in a region in the vicinity of the capillary, in particular a place where the electrode is seated in the capillary but at a distance from the wall of the capillary.

With increasing service life, there is an increase in the voltage required to ignite high-pressure discharge lamps. This can have the result that old lamps on conventional starting devices no longer start. However, it is necessary to guarantee an ignition capability over the entire lifetime, which is ensured by the arrangement according to the invention, without incurring significant additional costs. Hitherto, there were various possible solutions for this.

a) The burner gas filling is mixed with radioactive gas, for example Kr85. The radioactivity causes the gas filling to become ionized, which reduces the breakdown voltage and so ensures the ignition capability. However, the use of radioactivity is increasingly restricted by technical legislation.

b) A so-called UV enhancer is integrated in the outer bulb. This includes a miniaturized discharge tube which emits UV radiation on the application of the igniting voltage. This UV radiation also causes the burner gas filling to become ionized and hence ensures the ignition capability, see EP-A 922296.

c) A wire from the hanger wire is wound around the capillary with the opposite-pole electrode. On the application of the ignition voltage, this results in a dielectric barrier discharge in the region of this electrode which ionizes the burner gas filling and reduces the ignition voltage, see for example EP-A 967631.

The present arrangement embraces the principle of dielectric barrier discharge, but improves it decisively.

The hanger wire is designed so that a starting aid from there extends as closely as possible to the capillary with the opposite-pole electrode or touches said capillary. There, similarly to the case with the wire windings mentioned under c), a dielectric barrier discharge forms which ionizes the gas filling in the burner and enables a disruptive discharge. This solution is characterized by the fact that, contrary to previous solutions, the starting aid is a plate-like metal part. The metal part is in particular a foil or a sheet-metal part, in particular also a spring part. A typical size for a foil or sheet-metal part is a rectangle measuring 1 mm×10 mm.

In a preferred exemplary embodiment, a metal foil, preferably made of molybdenum or tungsten, is mechanically placed on the hanger wire and/or the capillary and comes into contact with the capillary with the electrode with the opposite potential. There, similarly to the wire windings mentioned under c), a dielectric barrier discharge forms which ionizes the gas filling in the burner and enables a disruptive discharge.

This solution is characterized by the use of a flexible foil, which, due to its compliance, is always in contact with the capillary of the discharge vessel. This requires the foil to be very thin, in all cases thinner than 200 μm, preferably between 20 μm and 40 μm. The foil does not have any mechanical supporting effect. It covers a large area of the capillary.

The foil can be adjacent to the capillary, partially or completely cover the capillary or be wound round the capillary.

The foil is fastened to the hanger wire and/or to the capillary either by bonding (e.g. by welding) or by friction-locking (e.g. by clamping or crimping).

With respect to the capillary, the foil can in particular lie adjacent to the tip, overlap it tangentially or be wound round the capillary. Preferably, it should have the simplest possible geometry, which does not impede production.

The starting aid preferably has the lowest possible distance to the opposite-pole current-conducting electrode, wherein, if possible, the location of the shortest distance should lie within the vicinity of the active discharge vessel.

According to various embodiments, radioactive admixtures are no longer required. From a production point of view, a foil led to the capillary is very simple to achieve with single-ended lamps and to be precise much simpler than a winding a wire around the capillary. In addition, unlike UV enhancers, the foil does not require any additional space in the outer bulb. There is virtually no risk of the starting aid losing its function or place due to poor joining to the hanger wire during the lifetime since a foil can be fastened to a relatively large area.

With single-ended lamps, from a production point of view, a foil fastened to the capillary is very simple to achieve with single-ended lamps; much simpler than a winding a wire around the capillary. In addition, unlike UV enhancers, the foil does not require any additional space in the outer bulb.

The foil can also be coated or doped.

A foil can be significantly buckled and nevertheless remain dimensionally stable. However, it can also retain its dimensional stability by means of a skilful suitable arrangement.

The hanger wire and the capillary with the opposite-pole electrode are in particular connected by a metal clip. As explained above, this clip achieves a dielectric barrier discharge, which reduces the ignition voltage. The clip is preferably made of a pre-bent metal foil. The shape is selected such that, due to pretensioning, the clip lies stably tightly on the capillary and/or the hanger wire.

There are various options for attaching the clip:

First exemplary embodiment: the clip is placed on the capillary, where it fits stably due to its pretensioning. Here, the pre-bent metal part must have a diameter smaller than the outer diameter of the capillary. The diameter should be 70%-90% of the capillary diameter. The connection to the hanger wire must be achieved in some other way, for example by welding or crimping.

Second exemplary embodiment: the clip is placed on the hanger wire. Here, once again the preform must have a smaller diameter than the hanger wire, ideally between 70% and 90%. The clip must be fastened to the capillary. This can be achieved by joining the metal foils on the side opposite to the hanger wire, for example by welding or crimping.

Third exemplary embodiment: the clip is designed two-sided, i.e. it can be placed on the capillary and the hanger wire. This can be performed during the construction of the lamp mount. In one possible variant, a spring can be inserted between the two ends of the clip. With this design, the clip can be placed on finished lamp mount from both sides.

The clip can be made of any heat-resistant and electrically conductive material. Production from molybdenum has been tried; other materials, such are various steels, are conceivable.

Special advantages: radioactive admixtures are no longer required. Unlike UV enhancers, the clip does not require any additional space in the outer bulb. Production is very simple to perform since, in the case of single-sided clips only one further connection, for example a spot weld, is required; in the case of two-sided clips, no further connection techniques are required. Mechanical contact is also provided by the pretensioning of the clip.

In a further embodiment, the clip is placed over the hanger wire while the foil is finally welded or fastened to the side of the capillary in some other way.

Instead of welding the clip to the hanger wire, in principle, any other permanent fixation shape is possible.

BRIEF DESCRIPTION OF THE DRAWINGS

In the drawings, like reference characters generally refer to the same parts throughout different views. The drawings are not necessarily to scale, emphasis instead being generally upon illustrating the principles of the invention. In the following description, various embodiments are described with reference to the following drawings, in which.

DETAILED DESCRIPTION

Figure 1A:
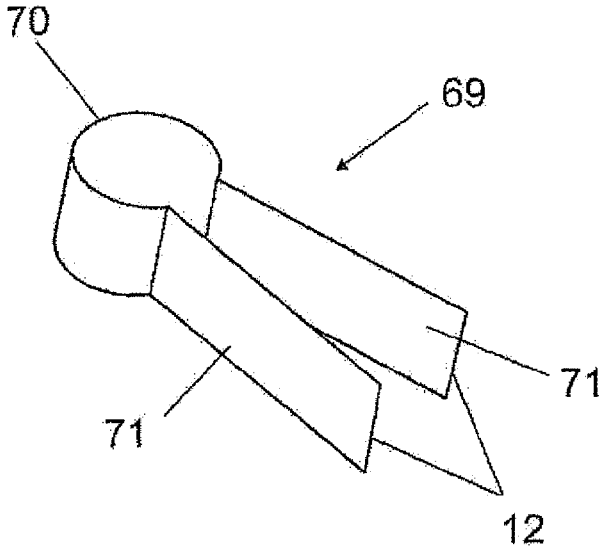
FIG. 1*a* high-pressure discharge lamp having a starting aid, first exemplary embodiment in three details, see FIGS. 1*a* to 1*d;*

The following detailed description refers to the accompanying drawings that show, by way of illustration, specific details and embodiments in which the invention may be practiced.

FIG. 1 shows the design of a high-pressure discharge lamp 1 in a very schematic fashion. According to FIG. 1*d*, it includes a discharge vessel 2 that is housed in an outer bulb 3. The external supply leads 4 of the discharge vessel which make contact with the electrodes in the interior are connected to two frame wires 5 and 6. A short frame wire 5 leads to a first foil 7 in a pinch 8 of the outer bulb. A long frame wire 6, frequently termed hanger wire, leads to a second foil 7 in the pinch 8. The discharge vessel 2 has at its respective ends a capillary 10, as known per se, and a filling, containing metal halides, as is likewise known per se. Here, it may contain Hg and inert gas. Two electrodes are opposite to each other in the interior of the discharge vessel, as is likewise known per se, but not shown here.

The hanger wire 6 is guided along the discharge vessel substantially parallel to the axis A to the second capillary 10 which is remote from the pinch 8. There, it is connected to the supply lead 4.

In the region of the first capillary 10, a foil 11, which is cut out approximately in a rectangle, is fastened in the direction toward the hanger wire. The end 12 of the foil extends to the hanger wire 6 and can protrude over this somewhat.

The detail in FIG. 1*a* shows the pre-bent foil 69 before fastening on the discharge vessel. It has a shape similar to a paper clip with central partial circular arc 70 enclosing a circumference of more than 270°. At the curved part 70, two, initially still free, limbs 71 are connected and can be easily separated from each other. These limbs are so long that they bridge the distance between the capillary and the hanger wire.

Figure 1B:
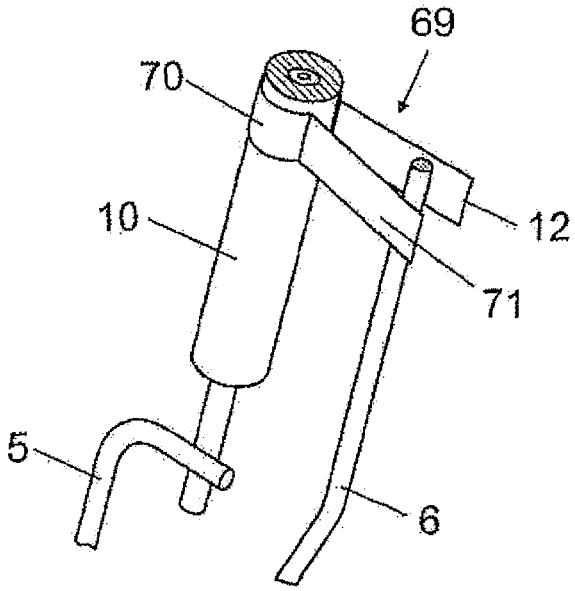

FIG. 1*b* shows a detail of the frame with the capillary 10. The foil 69 is pushed onto the capillary 10 such that the curved part 70 encompasses the capillary 10. The free limbs point roughly in the direction of the hanger wire, wherein this sits in the middle between the limbs.

Figure 1C:
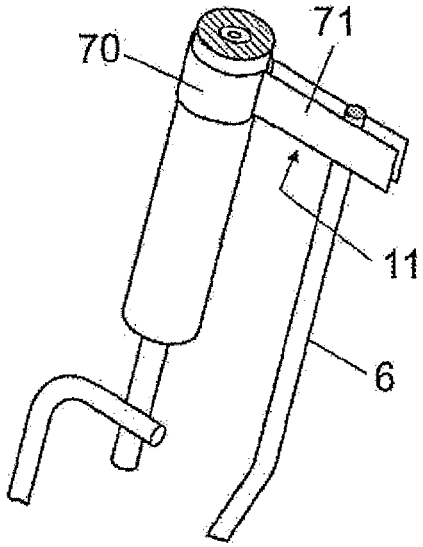
Figure 1D:
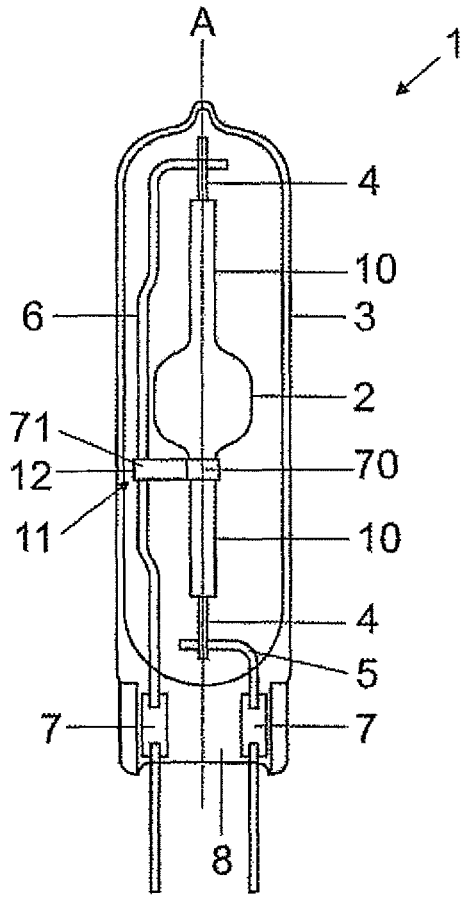

FIG. 1*c* shows that the free limbs 71 are then fixed on the hanger wire 6. They are pressed together and welded to the hanger wire 6 so to produce the finished fixed starting aid 11.

Figure 2A:
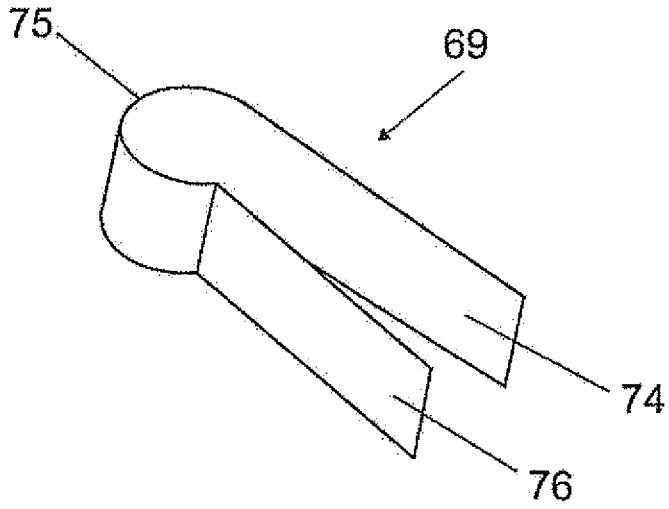
FIG. 2 a high-pressure discharge lamp having a starting aid, second exemplary embodiment in three details, see FIGS. 2*a* to 2*c;*
Figure 2B:
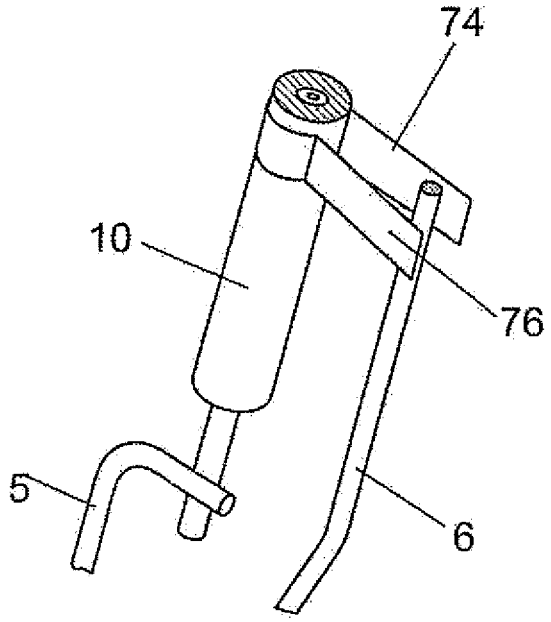
Figure 2C:
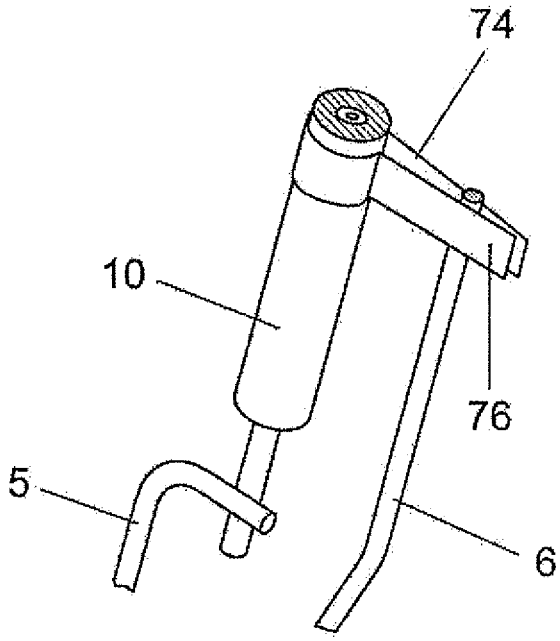

FIG. 2 shows an exemplary embodiment with a similar design to that in FIG. 1. However, here the foil 69 is pre-bent not symmetrically in the style of a paper clip, but asymmetrically on one side in the style of the German letter "β". Therefore, the foil 69 has a straight limb part 74 from which a curved part 75 is bent off tangentially.

The curved part is led back in a circular shape and then bent in the direction of a limb 76. This is spread slightly outward from the straight limb part 74, but is still virtually parallel thereto. Similarly to the case in FIG. 1, the foil 69 is placed on the capillary such that the hanger wire 6 comes to lie between the two limbs 74 and 76, see FIG. 2*b*. The two limbs 74 and 76 are then pressed together so that they both touch the hanger wire 6 from two sides. They are then welded to the hanger wire 6 to produce the finished starting aid 11.

Figure 3A:
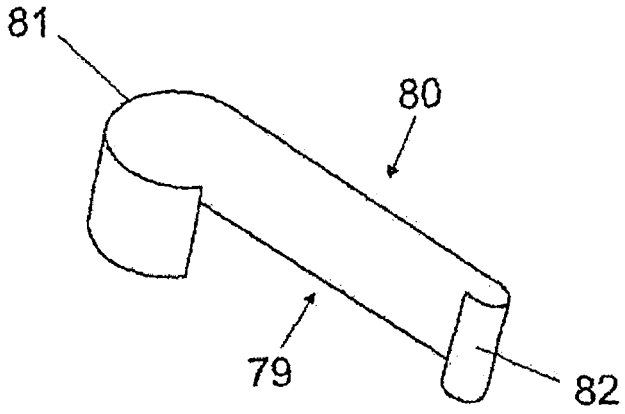
FIG. 3 a high-pressure discharge lamp having a starting aid, third exemplary embodiment in two details, see FIGS. 3*a* to 3*b;*
Figure 3B:
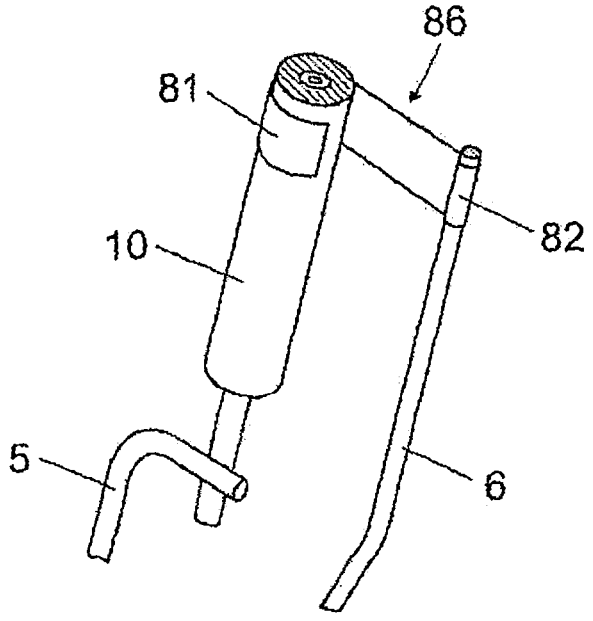

FIG. 3 shows a further exemplary embodiment of a pre-bent foil 80. This has a flat base body 79, which is rolled up at both ends. At a first end 81, there is a pre-bent first partial circular arc with a large radius. This radius is adapted to the outer diameter of the capillary. At a second end 82, there is a pre-bent partial circular arc with a smaller radius. This radius is suitably adapted to the hanger wire diameter. This foil 80 can simultaneously be suspended on the capillary 10 and on the hanger wire 6, see FIG. 3*b* and then subsequently to the hanger wire 6. Optionally, the purely mechanical fixation is sufficient so that no welding is necessary.

Figure 4A:
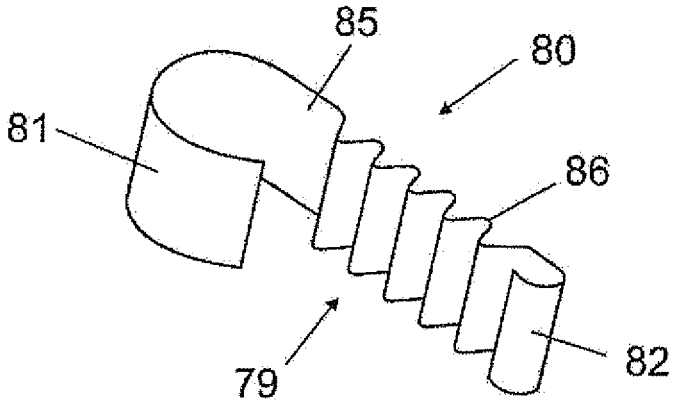
FIG. 4 a high-pressure discharge lamp having a starting aid, fourth exemplary embodiment in two details, see FIGS. 4*a* to 4*b.*
Figure 4B:
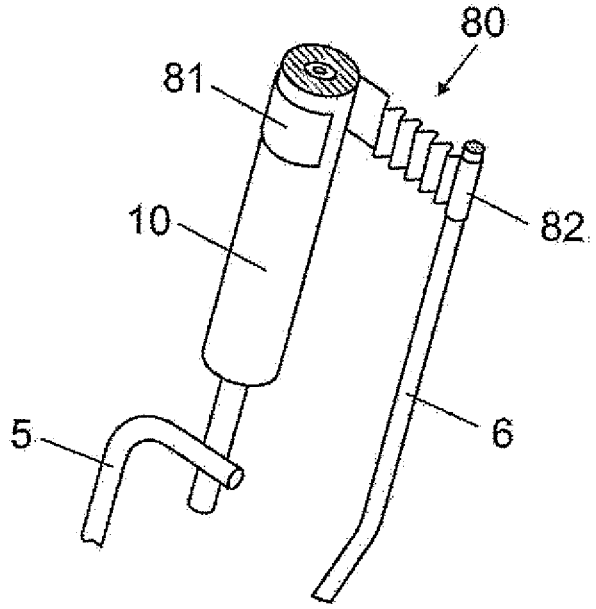

FIG. 4 shows a further exemplary embodiment of a pre-bent foil 80. Here, the basic structure of the foil, see FIG. 4*a*, is similar to that in FIG. 3. However, the actual foil body is not exclusively a flat surface 85 as in FIG. 3 but a more substantial part 86; preferably 20 to 80% of the length of the base body 79 is rippled in a concertina-like manner. The base body 79 is again rolled up at both ends. At a first end 81, there is a pre-bent first partial circular arc with a large radius. This radius is adapted to the outer diameter of the capillary. At a second end 82, there is a pre-bent second partial circular arc with a smaller radius. This radius is suitably adapted to the hanger wire diameter. This foil 80 can simultaneously be suspended on the capillary 10 and on the hanger wire 6, see FIG. 4*b*, and then subsequently welded to the hanger wire.

Various embodiments include:

1. A high-pressure discharge lamp having a starting aid and longitudinal axis A having a ceramic discharge vessel that is housed in an outer bulb, wherein the discharge vessel has two ends having capillaries wherein electrodes are fastened, wherein a frame having a hanger wire holds the discharge vessel in the outer bulb, characterized in that the hanger wire includes a plate-like starting aid toward the capillary of the opposite-pole electrode, which is in particular designed as a foil or metal sheet, wherein the plate-like starting aid comprises means for the purely mechanical fastening to at least the capillary.
2. The high-pressure discharge lamp as claimed in claim 1, characterized in that the starting aid is a foil the plane thereof being aligned axially parallel.
3. The high-pressure discharge lamp as claimed in claim 2, characterized in that an end of the foil is connected to the hanger wire by welding and the foil is at least partially wound round the capillary.
4. The high-pressure discharge lamp as claimed in claim 2, characterized in that the foil includes a partial circular arc (70; 75) as a central part enclosing the capillary while two limbs having free ends extend from the central part to at least the opposing sides of the hanger wire and are there welded to the hanger wire.
5. The high-pressure discharge lamp as claimed in claim 4, characterized in that the foil is embodied symmetrically in the form of a paper clip.
6. The high-pressure discharge lamp as claimed in claim 4, characterized in that the foil is embodied in the style of the German letter "β" and includes a partial circular arc as a central part positioned tangentially on a straight first limb, while the second limb is angled.
7. The high-pressure discharge lamp as claimed in claim 2, characterized in that the foil includes a flat base body and two rolled-up ends, wherein the radius of curvature of the first end is adapted to the outer diameter of the hanger wire and wherein the radius of curvature of the second end is adapted to the outer diameter of the hanger wire so that the foil can be attached to both by clamping.
8. The high-pressure discharge lamp as claimed in claim 7, characterized in that a part of the flat base body is rippled in a concertina-like manner.
9. The high-pressure discharge lamp as claimed in claim 1, characterized in that the discharge vessel has a metal halide filling.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

The invention claimed is:

1. A high-pressure discharge lamp having a starting aid and a longitudinal axis having a ceramic discharge vessel that is housed in an outer bulb, comprising: a discharge vessel including two ends comprising capillaries wherein electrodes are fastened, wherein a frame having a hanger wire holds the discharge vessel in the outer bulb, the hanger wire configured so that it comprises a plate-like starting aid touching the capillary of the opposite-pole electrode, the plate-like starting aid configured as a foil or metal sheet, the plate-like starting aid further comprising means for purely mechanical fastening to at least the capillary.

2. The high-pressure discharge lamp as claimed in claim 1, configured so that the starting aid is a foil the plane thereof being aligned axially parallel.

3. The high-pressure discharge lamp as claimed in claim 2, configured so that an end of the foil is connected to the hanger wire by welding and the foil is at least partially wound round the capillary.

4. The high-pressure discharge lamp as claimed in claim 2, configured so that the foil comprises a partial circular arc as a central part enclosing the capillary while two limbs having free ends extend from the central part to at least the opposing sides of the hanger wire and are there welded to the hanger wire.

5. The high-pressure discharge lamp as claimed in claim 4, configured so that the foil is embodied symmetrically in the form of a paper clip.

6. The high-pressure discharge lamp as claimed in claim 4, configured so that the foil is embodied in the style of the German letter "β" and comprises a partial circular arc as a central part positioned tangentially on a straight first limb, while the second limb is angled.

7. The high-pressure discharge lamp as claimed in claim 2 configured so that the foil comprises a flat base body and two rolled-up ends, wherein the radius of curvature of the first end is adapted to the outer diameter of the hanger wire and wherein the radius of curvature of the second end is adapted to the outer diameter of the hanger wire so that the foil can be attached to both by clamping.

8. The high-pressure discharge lamp as claimed in claim 7 configured so that a part of the flat base body is rippled in a concertina-like manner.

9. The high-pressure discharge lamp as claimed in claim 1, configured so that the discharge vessel has a metal halide filling.

* * * * *